US006616029B1

(12) United States Patent
Andersson

(10) Patent No.: US 6,616,029 B1
(45) Date of Patent: Sep. 9, 2003

(54) STAPLER WITH REVERSIBLE ELECTRIC MOTOR

(75) Inventor: Mats Andersson, Mullsjö (SE)

(73) Assignee: Isaberg Rapid AB, Hestra (SE)

( * ) Notice: Subject to any disclaimer, the term of this patent is extended or adjusted under 35 U.S.C. 154(b) by 0 days.

(21) Appl. No.: 10/168,176

(22) PCT Filed: Nov. 23, 2000

(86) PCT No.: PCT/SE00/02301

§ 371 (c)(1),
(2), (4) Date: Jun. 19, 2002

(87) PCT Pub. No.: WO01/45907

PCT Pub. Date: Jun. 28, 2001

(30) Foreign Application Priority Data

Dec. 21, 1999 (SE) ..... 9904682
Mar. 31, 2000 (SE) ..... 0001145

(51) Int. Cl.[7] ..... B27F 7/36; B25C 1/06
(52) U.S. Cl. ..... 227/155; 227/131; 270/58.08
(58) Field of Search ..... 227/155, 131, 227/153, 135, 138, 2; 270/58.08, 58.01, 53

(56) References Cited

U.S. PATENT DOCUMENTS 4,720,033 A 1/1988 Olesen ..... 227/131
5,230,457 A * 7/1993 Hiroi et al. ..... 227/131
5,474,222 A * 12/1995 Kanai et al. ..... 227/155
5,573,233 A * 11/1996 Hirai et al. ..... 270/58.08
5,582,340 A * 12/1996 Eriksson ..... 227/131
5,702,047 A * 12/1997 Yoshie ..... 227/131
5,836,502 A * 11/1998 Kanai et al. ..... 227/155
5,975,396 A * 11/1999 Manabe ..... 227/2

FOREIGN PATENT DOCUMENTS

| | | |
|---|---|---|
| EP | 0 579 118 | 1/1994 |
| EP | 0 919 343 | 6/1999 |
| GB | 2 212 433 | 7/1989 |
| SE | 469 114 | 5/1993 |

* cited by examiner

*Primary Examiner*—Scott A. Smith
(74) *Attorney, Agent, or Firm*—Miles & Stockbridge P.C.

(57) ABSTRACT

A stapler for driving staples into objects comprises an anvil element (16) and stapling element (1), which cooperates with the anvil element and which contains staples. The stapler further comprises a driver (8), which is reciprocatingly arranged on the stapling element (1) and which is arranged to drive a staple into the object in the direction of the anvil element. An operating element (10) is arranged to reciprocate the driver (8). The anvil element (16) and the operating element (10) are movable back and forth relative to the stapling element (1) in one and the same path of motion. The anvil element (16) and the operating element (10) are movable relative to each other in this path of motion with the aid of reversible driving elements (19, 23, 26, 27, 29, 30, 32). The inertia of the operating element (10) against movement relative to the stapling element (1) is greater than its inertia against movement relative to the anvil element (16). The driving elements (19, 23, 26, 27, 29, 30, 32) are adapted to be reversed, on the one hand, when in a first position the operating element (10) cannot move the driver (8) any further in its drive-in direction and, on the other hand, when in a second position it cannot move the driver (8) any further in the opposite direction.

20 Claims, 14 Drawing Sheets

STAPLER WITH REVERSIBLE ELECTRIC MOTOR

The present invention relates to a stapler for driving staples into objects, such as sheaves of papers, said stapler comprising an anvil element, which has a means for clinching driven-in staples, and a stapling element, which cooperates with the anvil element and which contains staples, one of the anvil element and the stapling element being fixedly arranged in the stapler, and these elements being movable relative to each other between a starting position and a working position, in which they are applied against an object, when this is placed in the stapler between the anvil element and the stapling element to be stapled, and said stapler further comprising a driver, which is reciprocatingly arranged on the stapling element and which is arranged to drive a staple into the object in the direction of the anvil element, and an operating element, which is arranged to reciprocate the driver and which, for this purpose, is movable relative to the stapling element; the anvil element and the operating element being movable back and forth relative to the stapling element in one and the same path of motion, and the anvil element and the operating element being movable relative to each other in said path of motion with the aid of a reversible driving means.

In a conventional stapler, the anvil element is attached to a fixed base and the stapling element is pivotally connected to the base on a first axis in order to be pivoted, for instance when a sheaf of papers is placed on the anvil element, towards said anvil element and be applied against the sheaf of papers. The operating element has two arms, which are pivotally connected to the stapling element on an axis parallel to the first axis in order to be pivoted, when the stapling element is in its working position and is applied against the sheaf of papers, in the direction of the base, thus driving a staple into the object. As should be understood, the working position of the stapling element, i.e. the position in which the stapling element is applied against the sheaf of papers and presses the same against the anvil element, depends on the thickness of the sheaf of papers. To compensate for these variations in the thickness of the sheaf and to guide and drive the stapling element and the operating element in such a manner that it will be possible to staple sheaves of papers of varying thickness in a reliable manner, use is made today of different types of cam controls, locking mechanisms and spring arrangements, resulting in the stapler containing many parts and being unwieldy and expensive.

Therefore the object of the present invention is to provide a simple and compact stapler, which makes it possible to provide, in a simple manner, an automatic compensation for varying thickness of the objects which are to be stapled.

According to the invention, this object is achieved by a stapler, which is of the kind stated by way of introduction and characterised in that the operating element is movably connected to the stapling element and the anvil element in such a manner that its inertia against movement relative to the stapling element is greater than its inertia against movement relative to the anvil element, which means that, when the driving means is driven in one direction, the anvil element and the stapling element are first moved relative to each other from the starting position to the working position and the operating element is subsequently moved relative to the stapling element to move the driver in its drive-in direction, and that, when the driving means after reversal is driven in the other direction, the anvil element and the stapling element are first moved relative to each other from the working position to the starting position and the operating element is subsequently moved relative to the stapling element in order to move the driver in the direction opposite to the drive-in direction, and that the driving means is adapted to be reversed, on the one hand, when the operating element, when driving the driving means in said one direction, reaches a first position, in which it cannot move the driver any further in its drive-in direction and, on the other hand, when the operating element, when driving the driving means in said other direction, reaches a second position, in which it cannot move the driver any further in the direction opposite to the drive-in direction.

The driving means advantageously comprises a reversible electric motor, and the rise of current which is obtained in the motor when it stalls due to the operating element being stopped in its movement in said first and second position is used as a signal to reverse the motor.

In a first preferred embodiment, the anvil element and the operating element are linearly movable, along one and the same straight line, back and forth relative to the stapling element. The electric motor is suitably fixed to one of the operating element and the anvil element. If in this first preferred embodiment the stapling element is fixedly arranged in the stapler, the anvil element, the stapling element and the operating element are suitably arranged in a vertical line and movable relative to each other along this line, the anvil element being arranged above the stapling element. If in the first preferred embodiment the anvil element is fixedly arranged in the stapler, the anvil element, the stapling element and the operating element are suitably arranged in a vertical line and movable relative to each other along this line, the stapling element being arranged above the anvil element.

In the first preferred embodiment, the driving means suitably comprises at least one gear, which meshes with a rack that is fixed to the other one of the operating element and the anvil element.

In a second preferred embodiment, the anvil element and the operating element are pivotable back and forth relative to the stapling element on one and the same axis. If in the second preferred embodiment the stapling element is fixedly arranged in the stapler, the anvil element is suitably arranged above the stapling element. If in the second preferred embodiment the anvil element is fixedly arranged in the stapler, the stapling element is suitably arranged above the anvil element.

The invention will now be described in more detail with reference to the accompanying drawings.

Figure 1:
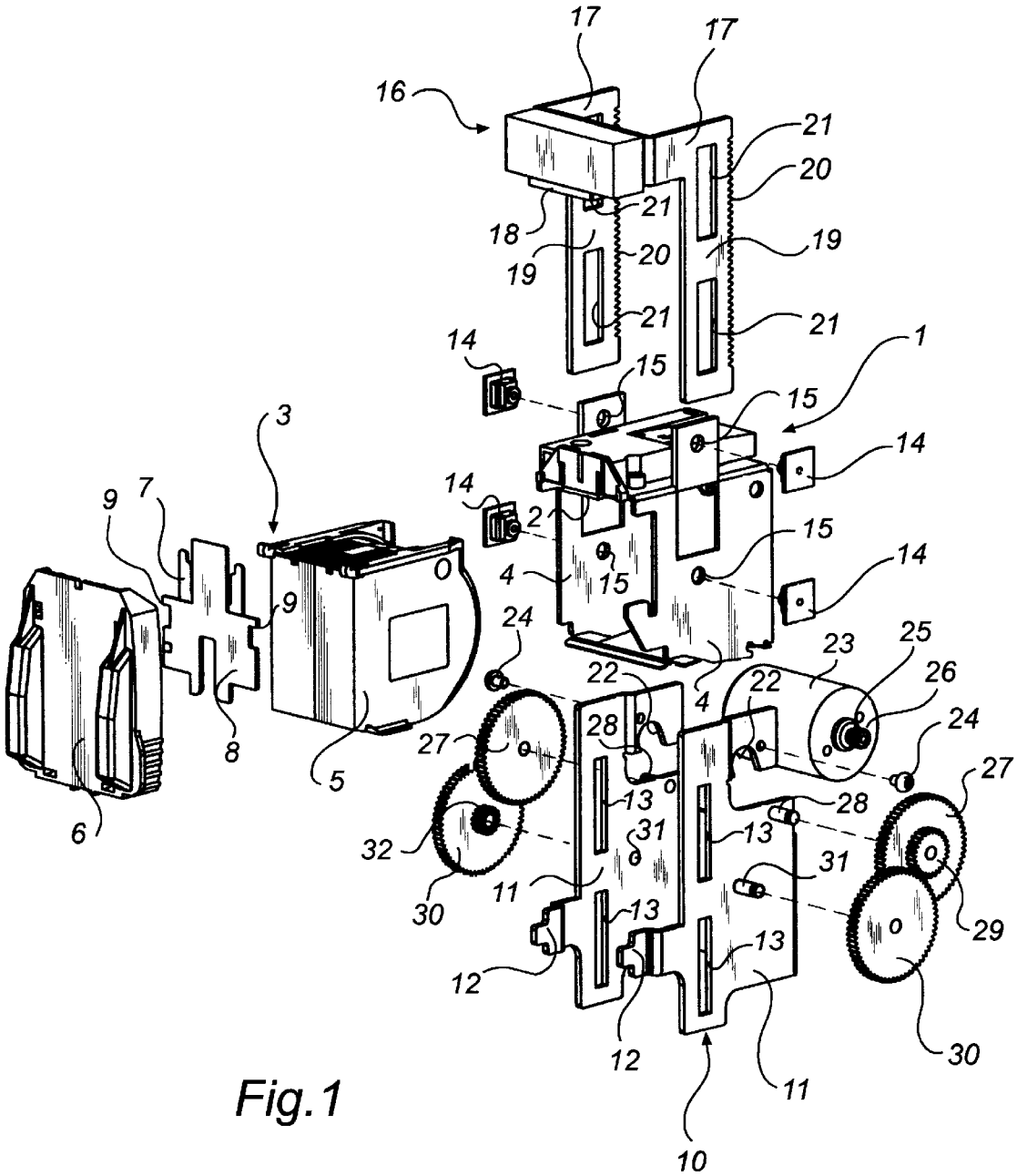
FIG. 1 is an exploded view showing a first embodiment of a stapler according to the invention.

The stapler illustrated in FIGS. 1–6 has a stapling element 1 in the form of a fixed base. The stapling element 1 has the shape of an inverted U and comprises a bending anvil 2 in its upper, front portion. A replaceable cassette 3 is releasably secured in the stapling element 1 between its legs 4. The cassette 3 has a housing 5 containing straight wire-shaped staple blanks, which are juxtaposed and releasably interconnected to form a strip of staple blanks, which is rolled up into a roll. The cassette 3 also has a front plate 6, in which a staple shaper 7 and a staple driver 8 are arranged to be synchronously moved up and down. When the staple shaper 7 is moved upwards, it bends in prior-art manner a straight staple blank over the bending anvil 2 into a U-shaped staple, which is to be driven, for instance, into a sheaf of papers. When the staple driver 8 is moved upwards, it drives into the sheaf of papers, also in prior-art manner, the U-shaped staple which was bent in the immediately preceding movement upwards of the shaper 7. The shaper 7 as well as the driver 8 have a cutout 9 in each of their side edges.

An operating element 10 is adapted to move the shaper 7 and the driver 8 and has the shape of a horizontally extending U, whose legs 11 are vertical and extend forwards from the U web portion. Each leg 11 has a projection 12, which extends forwards and engages the corresponding cutout 9 in the shaper 7 and the driver 8.

In each of its legs 11, the operating element 10 has two vertical slots 13 arranged in a line. The operating element 10 straddles the stapling element 1 and is mounted on the same by means of four guide pins 14 to be movable back and forth in the vertical direction, said guide pins each extending through a slot 13 and being secured by means of screws (not shown) in a hole 15 each in the stapling element 1. Each guide pin 14 has a first rectangular portion, which is situated in the respective slots 13 and whose width equals the width of the slot 13.

An anvil element 16 has the shape of a horizontally extending U, whose legs 17 are vertical and extend backwards from the U web portion. The web portion supports an anvil 18 turned downwards. When the staple is driven into the sheaf of papers in the above-described manner, the legs of the staple hit the anvil 18 to be bent by the same. The anvil 18 can be replaced in prior-art manner by an active clinching mechanism having turnable clinching means for clinching the staple legs. A rack 19 with teeth 20 facing backwards extends vertically downwards from each leg 17. Each rack 19 has two vertical slots 21 arranged in a line, which are somewhat wider than the slots 13 in the legs 11 of the operating element 10. The anvil element 16 straddles the operating element 10 and is mounted on the same by means of the four guide pins 14 to be movable back and forth in the vertical direction, said guide pins also extending through a slot 21 each in the racks 19. Each guide pin 14 also has a second rectangular portion, which is situated in the respective slots 21 and whose width equals the width of the slot 21.

The stapling element 1, the operating element 10 and the anvil element 16 are thus linearly movable back and forth relative to each other along one and the same vertical line.

Each of the two legs 11 of the operating element 10 has in its upper portion a cutout 22 with an opening turned downwards. A reversible electric motor 23 is arranged between the legs 11 and fixed thereto by means of screws 24. At each of its ends, the motor 23 has an output shaft 25, which projects a certain distance beyond the respective legs 11 via the respective cutouts 22. Each shaft 25 cooperates with a gear, which consists of a smaller gear wheel 26 that is non-rotatably connected to the shaft 25, a larger gear wheel 27 that is rotatably mounted on a pivot pin 28 on the operating element 10 and meshes with the gear wheel 26, a smaller gear wheel 29 that is non-rotatably connected to the gear wheel 27 at the outside thereof, a larger gear wheel 30 that is rotatably mounted on a pivot pin 31 on the operating element 10 and meshes with the gear wheel 29, and a smaller gear wheel 32 that is non-rotatably connected to the gear wheel 30 at the inside thereof and meshes with the corresponding rack 19.

Figure 2:
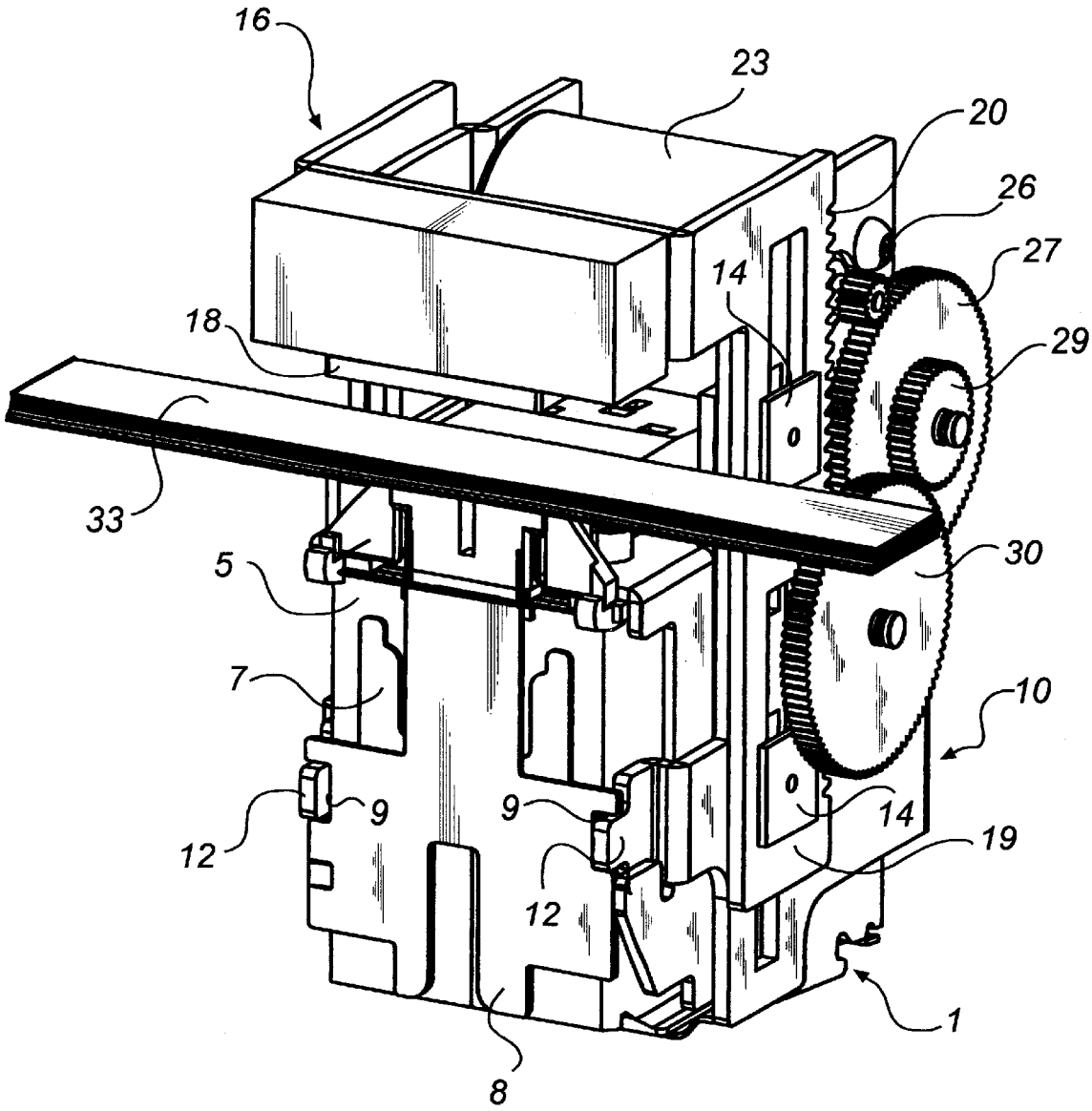
FIGS. 2–6 are perspective views showing the stapler according to FIG. 1 on a larger scale and in different working phases.
Figure 3:
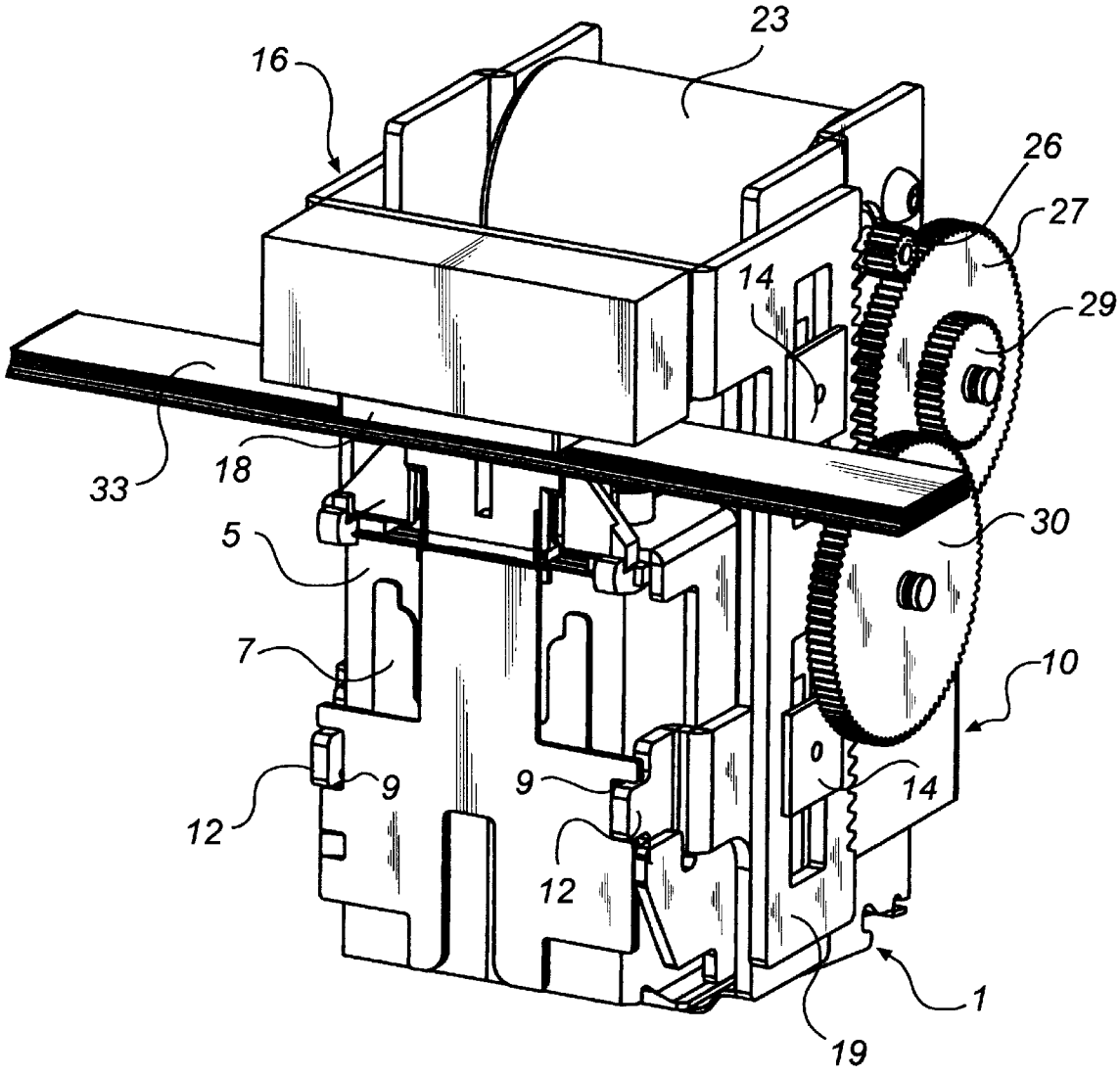
Figure 4:
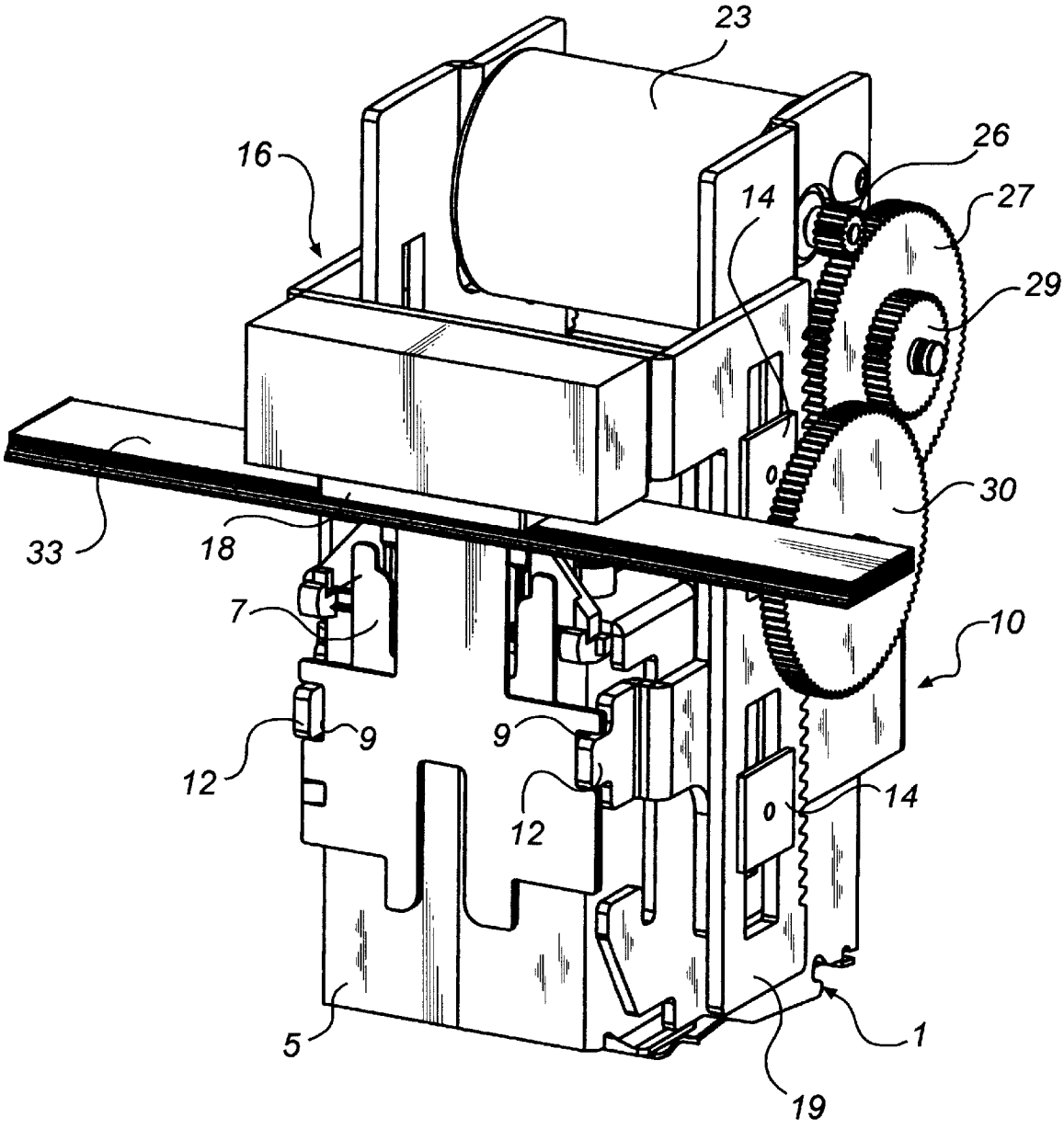

When a sheaf of papers 33 is to be stapled, an edge portion thereof is inserted between the anvil element 16 and the stapling element 1 and is placed on the latter, as shown in FIG. 2. Subsequently, the motor 23 is started, for instance, by means of a trigger mechanism (not shown), which is actuated when placing the sheaf of papers 33 in the stapler. The motor 23 rotates in such a direction that the operating element 10 and the anvil element 16 are moved closer to each other from the starting position shown in FIG. 2. Due to the fact that the operating element 10 is to entrain the staple shaper 7 and the staple driver 8, the inertia of the operating element 10 against linear movement relative to the fixed stapling element 1 is greater than the inertia of the anvil element 16 against linear movement relative to the fixed stapling element 1. This means that initially the operating element 10 is immobile, whereas the anvil element 16 is moved downwards, until the anvil 18 abuts against the sheaf of papers 33 (FIG. 3) and presses the same against the stapling element 1, independently of the thickness of the sheaf of papers 33.

Figure 5:
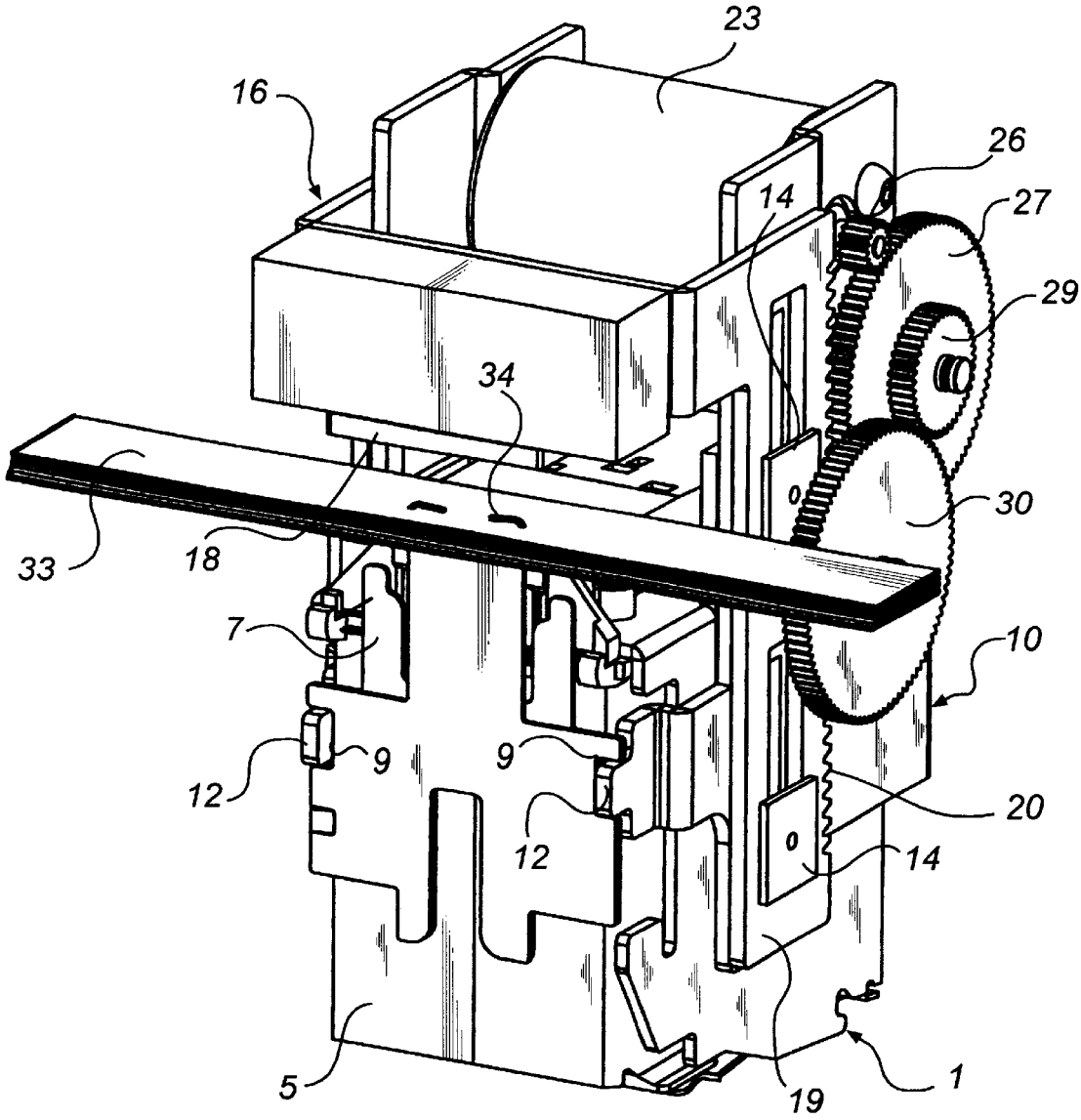

When the anvil element 16 cannot be moved downwards any further and is thus stopped, the operating element 10 is moved upwards and entrains in its movement the staple shaper 7 and the staple driver 8, due to their engagement with the projections 12. The shaper 7 then forms, in the above-described manner, a straight staple blank into a U-shaped staple, at the same time as the driver 8 drives a staple 34 into the sheaf of papers in the above-described manner. When the legs of the staple 34 hit the anvil 18, they are clinched, as shown in FIG. 5.

Figure 6:
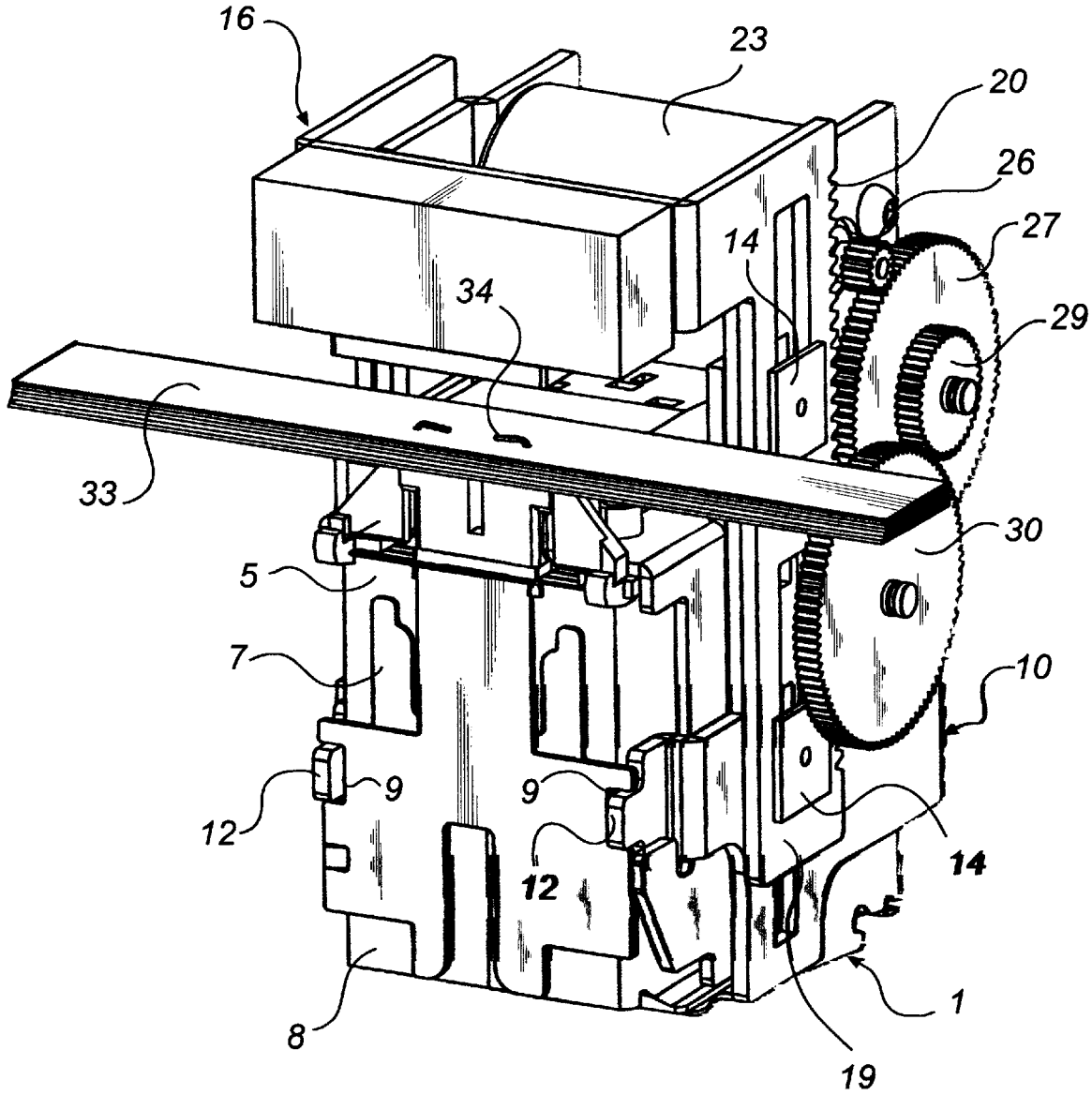

When the operating element 10 cannot be moved upwards any further and is thus stopped (FIG. 4), the electric motor 23 enters a stalling state, in which a considerable rise of current is obtained in the motor. This rise of current is used as a signal, which initiates a reversal of the motor. The motor 23 then rotates in such a direction that the operating element 10 and the anvil element 16 are moved away from each other from the position shown in FIG. 4. Due to the above-described conditions of inertia, the anvil element 16 is first moved upwards to its starting position (FIG. 5) and then the operating element 10 is moved downwards to its starting position (FIG. 6). When the operating element 10 has reached its starting position, it cannot be moved downwards any further. This results in the electric motor 23 entering a stalling state once again. The considerable rise of current which is then obtained in the motor 23 is used as a signal that stops the motor.

Figure 7:
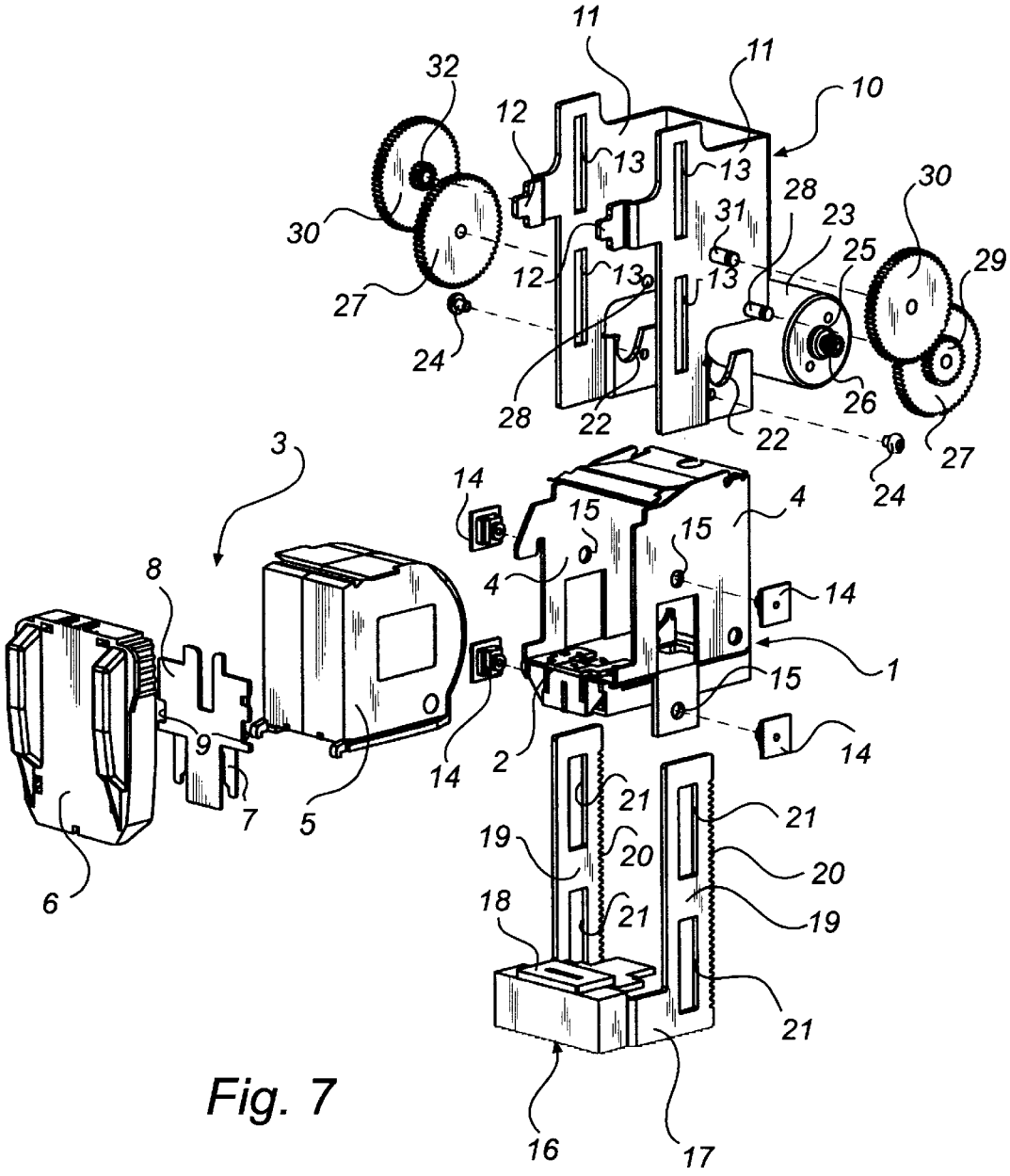
FIG. 7 is an exploded view showing a variant of the embodiment shown in FIG. 1.
Figure 8:
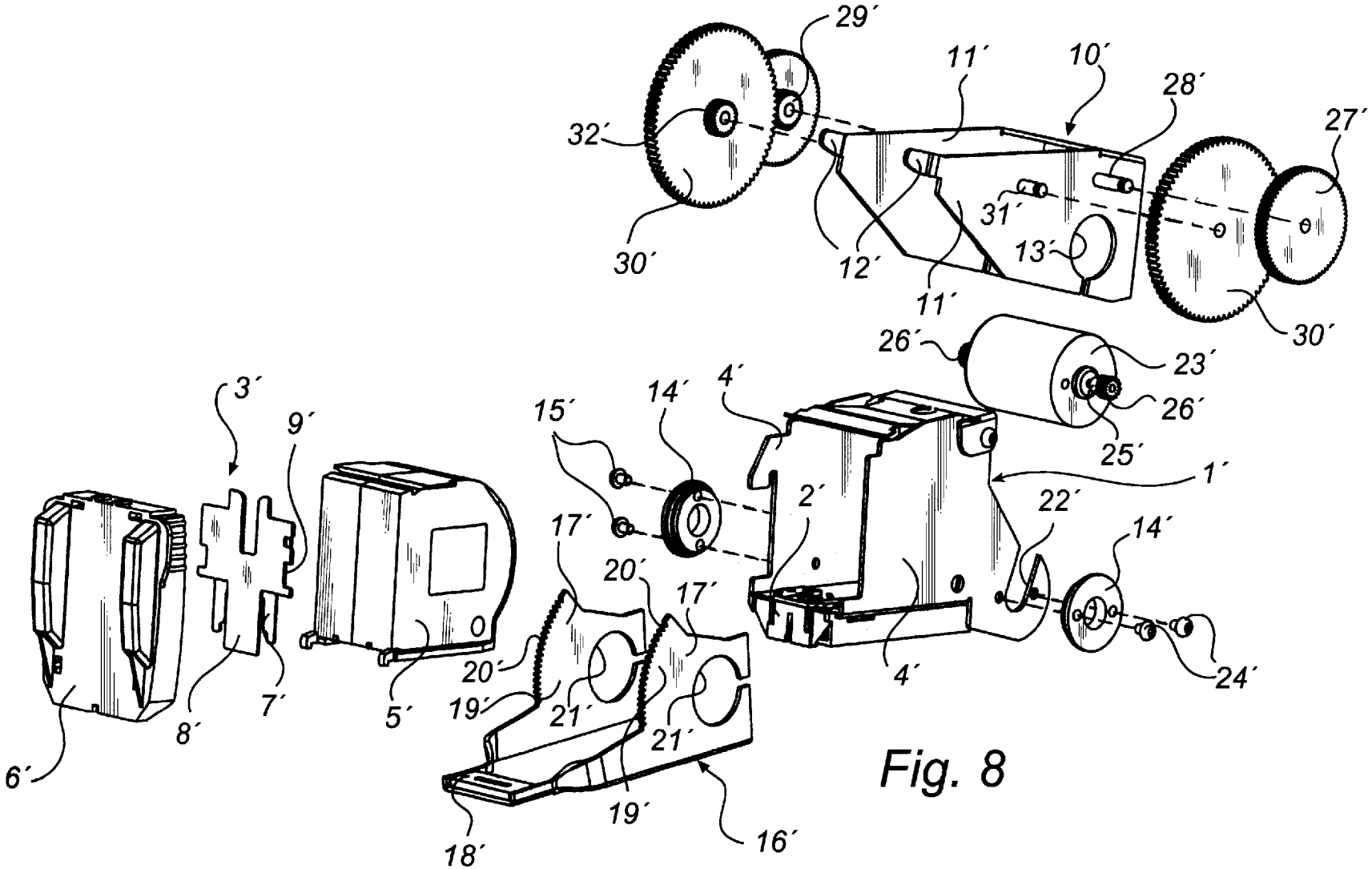
FIG. 8 is an exploded view showing a second embodiment of a stapler according to the invention.

The stapler shown in FIG. 7 differs from the stapler according to FIGS. 1–6 essentially only in that the stapler is turned upside-down and that the anvil element 16, and not the stapling element 1, is fixedly arranged in the stapler. As seen, the same reference numerals are used in FIG. 7 as in FIGS. 1–6.

When a sheaf of papers is to be stapled, it is not placed, as in the stapler according to FIGS. 1–6, on the stapling element 1 but on the anvil 18. Subsequently, the motor 23 is started in the same way as in the stapler according to FIGS. 1–6, but in this case, due to the above-described conditions of inertia, the operating element 10 is first moved downwards together with the stapling element 1, until the stapling element 1 abuts against the sheaf of papers and presses the same against the anvil 18, also in this case independently of the thickness of the sheaf of papers. When the stapling element 1 cannot be moved downwards any further and is thus stopped, the operating element 10 is moved downwards and entrains the staple shaper 7 and the staple driver 8 to form and drive in a staple blank and a staple, respectively.

When the operating element 10 cannot be moved downwards any further and is thus stopped, the electric motor 23 enters a stalling state and is reversed in the same manner as in the stapler according to FIGS. 1–6. The operating element 10 is then moved upwards to its starting position, first together with the stapling element 1 and then alone, after the stapling element has reached its starting position. When the operating element 10 has reached its starting position, it cannot be moved upwards any further, resulting in the electric motor 23 entering a stalling state and being stopped in the same manner as in the stapler according to FIGS. 1–6.

The staplers shown in FIGS. 8–14 have elements that are pivotable in relation to each other instead of being linearly movable in relation to each other, but otherwise they are so similar to the staplers shown in FIGS. 1–7 that the same reference numerals are used when describing the staplers according to FIGS. 8–14 as when describing the staplers according to FIGS. 1–7. The parts in the first-mentioned staplers (FIGS. 8–14) are, however, provided with prime marks.

The stapler shown in FIGS. 8–13 comprises a stapling element 1', which is substantially U-shaped and which has a bending anvil 2' in its lower, front portion. A replaceable cassette 3' is releasably secured in the stapling element 1' between its legs 4'. The cassette 3' has a housing 5' containing straight wire-shaped staple blanks, which are juxtaposed and releasably interconnected to form a strip of staple blanks, which is rolled up into a roll. The cassette 3' also has a front plate 6', in which a staple shaper 7' and a staple driver 8' are arranged to be synchronously moved up and down. When the staple shaper 7' is moved downwards, it bends in prior-art manner a straight staple blank over the bending anvil 2' into a U-shaped staple, which is to be driven, for instance, into a sheaf of papers. When the staple driver 8' is moved downwards, it drives into the sheaf of papers, also in prior-art manner, the U-shaped staple which was bent in the immediately preceding movement downwards of the shaper 7'. The shaper 7' as well as the driver 8' have a cutout 9' in each of their side edges. An operating element 10' is adapted to move the shaper 7' and the driver 8' and has the shape of a horizontally extending U, whose legs 11' are vertical and extend forwards from the U web portion. Each leg 11' has a projection 12', which extends forwards and engages the corresponding cutout 9' in the shaper 7' and the driver 8'.

The operating element 10 has a circular hole 13' in each of its legs 11'. The holes 13' in the two legs 11' are axially aligned. The operating element 10' straddles the stapling element 1' and is mounted on the same by means of two guide pins 14' to be pivotable back and forth in the vertical direction, said guide pins each extending into a hole 13' and being secured to the stapling element 1' by means of screws 24'. Each guide pin 14' has a first circular portion, which is situated in the respective holes 13' and whose diameter equals the diameter of the hole 13'.

An anvil element 16', which is fixedly arranged in the stapler, has the shape of a U, whose legs 17' are vertical and extend upwards from the U web portion. In its front portion, the web portion supports an anvil 18' turned upwards. When the staple is driven into the sheaf of papers in the above-described manner, the legs of the staple hit the anvil 18' to be bent by the same. The anvil 18' can be replaced in prior-art manner by an active clinching mechanism having turnable clinching means for clinching the staple legs. Each leg 17' is formed as a toothed segment 19' having teeth 20' facing forwards. Each leg 17' has a circular hole 21', whose diameter is somewhat larger than the diameter of the holes 13'. The holes 21 are axially aligned, their centre axis coinciding with the centre axis of the toothed segments 19'. The anvil element 16' straddles the operating element 10' and is mounted on the same and on the stapling element 1' by means of the two guide pins 14' to be pivotable back and forth in the vertical direction, said guide pins extending through a hole 21' each in the legs 17'. Each guide pin 14' also has a second circular portion, which is situated in the respective holes 21' and whose diameter equals the diameter of the hole 21'.

The stapling element 1', the operating element 10' and the anvil element 16' are thus pivotable back and forth relative to each other on one and the same pivot axis.

Each of the two legs 4' of the stapling element 1 has in its lower portion a cutout 22' with an opening turned upwards. A reversible electric motor 23' is arranged between the legs 4' and fixed thereto by means of the screws 24', which extend through screw holes in the legs 4' of the stapling element 1' and are screwed into screw holes in the motor 23'. At each of its ends, the motor 23' has an output shaft 25', which projects a certain distance beyond the respective legs 4' via the respective cutouts 22'. Each shaft 25' cooperates with a gear, which consists of a smaller gear wheel 26' that is non-rotatably connected to the shaft 25', a larger gear wheel 27' that is rotatably mounted on a pivot pin 28' on the operating element 10' and meshes with the gear wheel 26', a smaller gear wheel 29' that is non-rotatably connected to the gear wheel 27' at the inside thereof, a larger gear wheel 30' that is rotatably mounted on a pivot pin 31' on the operating element 10' and meshes with the gear wheel 29', and a smaller gear wheel 32' that is non-rotatably connected to the gear wheel 30' at the inside thereof and meshes with the corresponding toothed segment 19'.

Figure 9:
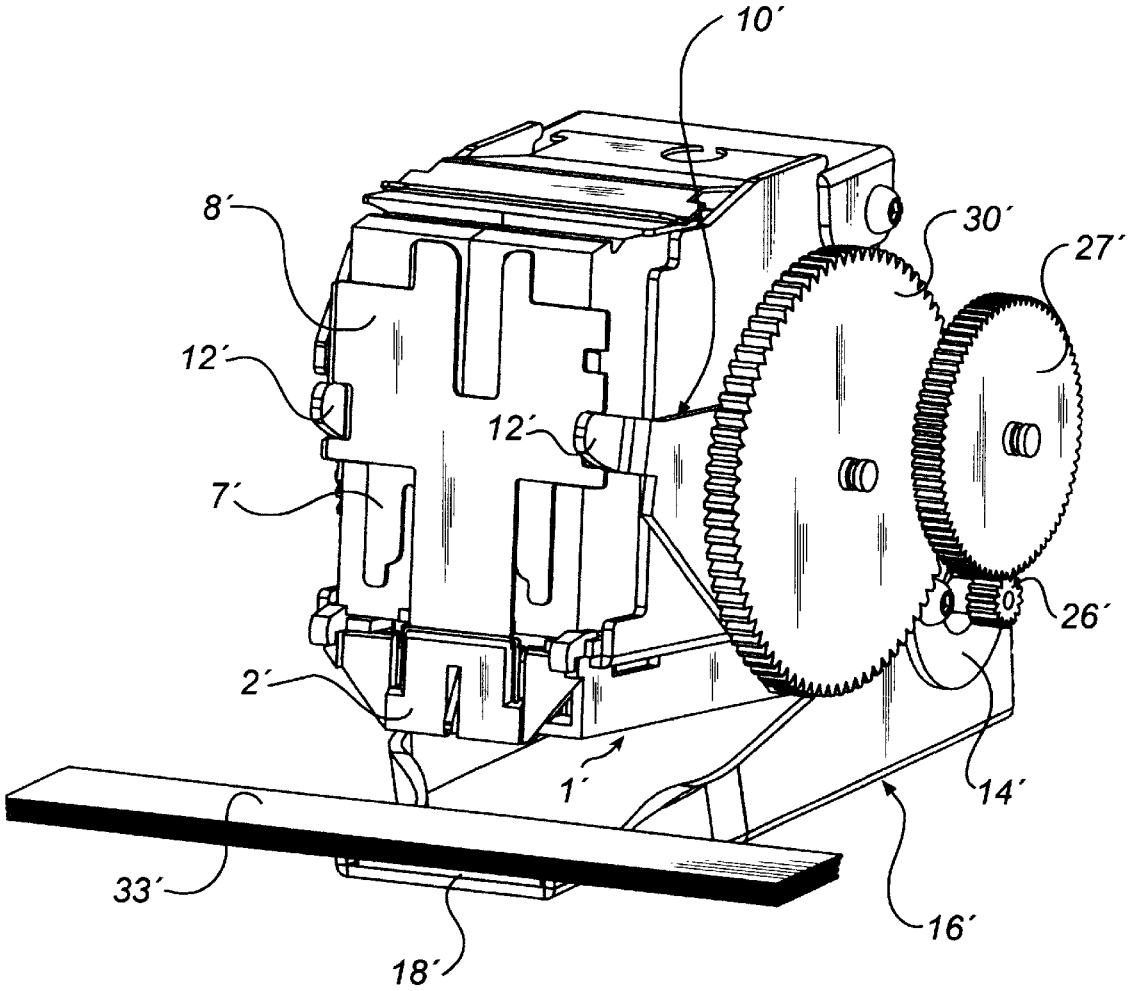
FIGS. 9–13 are perspective views showing the stapler according to FIG. 8 on a larger scale and in different working phases.
Figure 10:
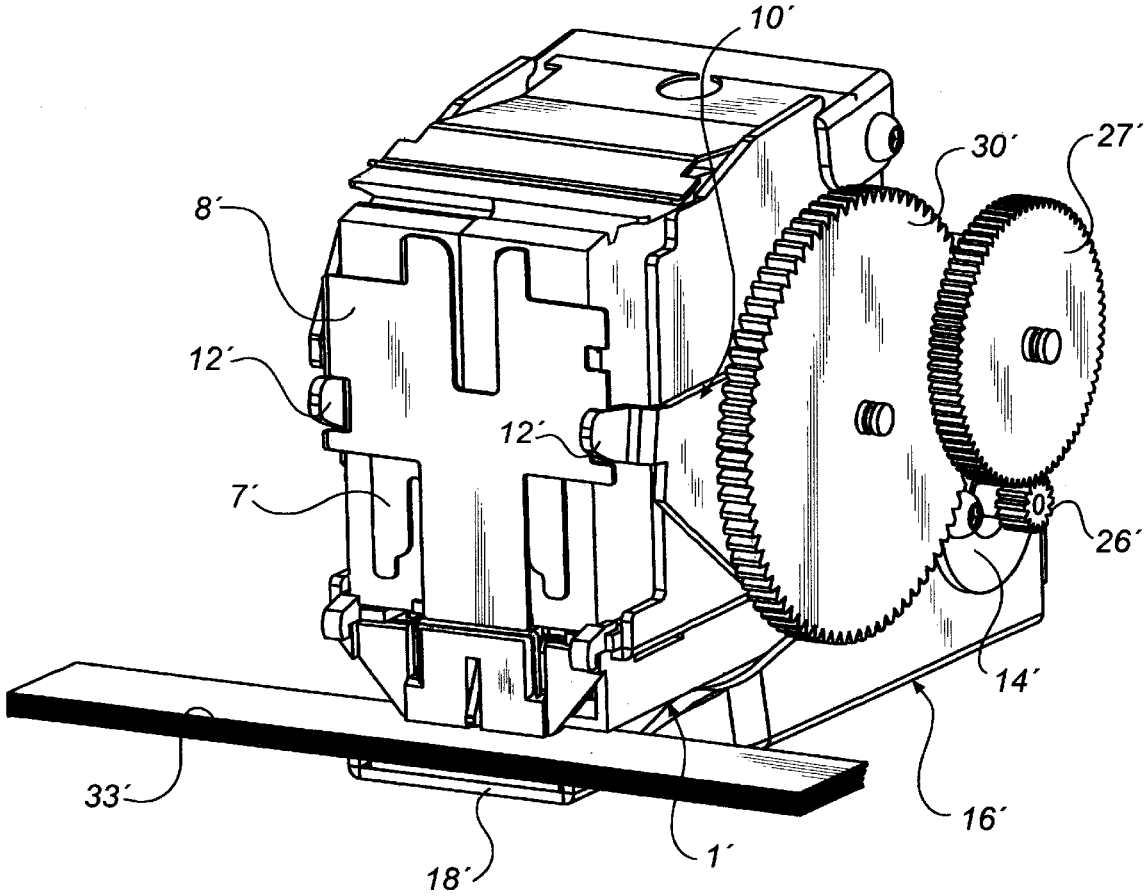
Figure 11:
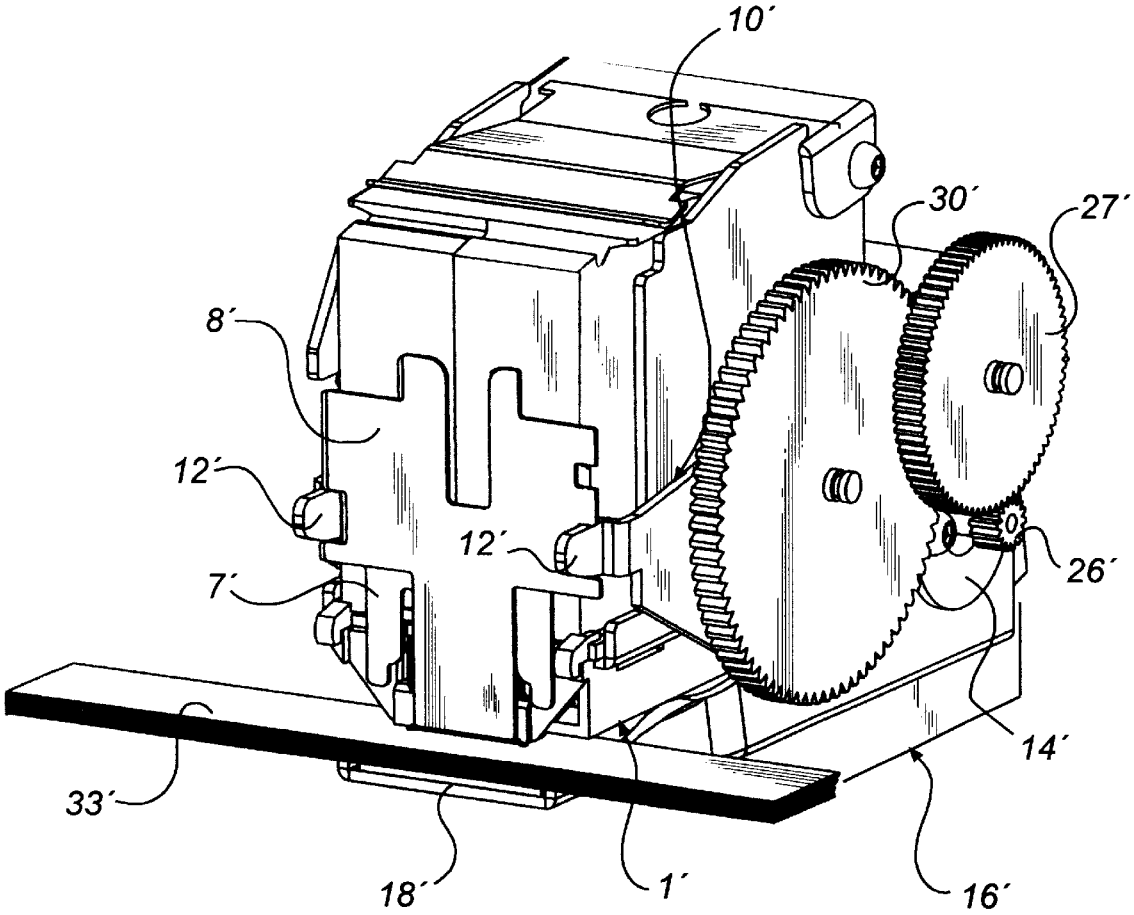

When a sheaf of papers 33' is to be stapled, an edge portion thereof is inserted between the stapling element 1' and the anvil element 16' and is placed on the latter, as shown in FIG. 9. Subsequently, the motor 23' is started, for instance, by means of a trigger mechanism (not shown), which is actuated when placing the sheaf of papers 33' in the stapler. The motor 23' rotates in such a direction that the stapling element 1' and the operating element 10' on the one hand and the anvil element 16' on the other hand are moved closer to each other from the starting position shown in FIG. 9. Due to the fact that the operating element 10' is to entrain the staple shaper 7' and the staple driver 8', the inertia of the operating element 10' against pivotal movement relative to the stapling element 1' is greater than the inertia of the stapling element 1' against pivotal movement relative to the fixed anvil element 16'. This means that initially the operating element 10' is immobile in relation to the stapling element 1' and is pivoted downwards together with the same, until the stapling element 1' abuts against the sheaf of papers 33' (FIG. 10) and presses the same against the anvil 18', independently of the thickness of the sheaf of papers 33'.

When the stapling element 1' cannot be pivoted downwards any further and is thus stopped, the operating element 10' is pivoted downwards and entrains in its movement the staple shaper 7' and the staple driver 8', due to their engagement with the projections 12'. The shaper 7' then forms, in the above-described manner, a straight staple blank into a U-shaped staple, at the same time as the driver 8' drives a staple 34' into the sheaf of papers in the above-described manner. When the legs of the staple 34' hit the anvil 18', they are clinched.

Figure 12:
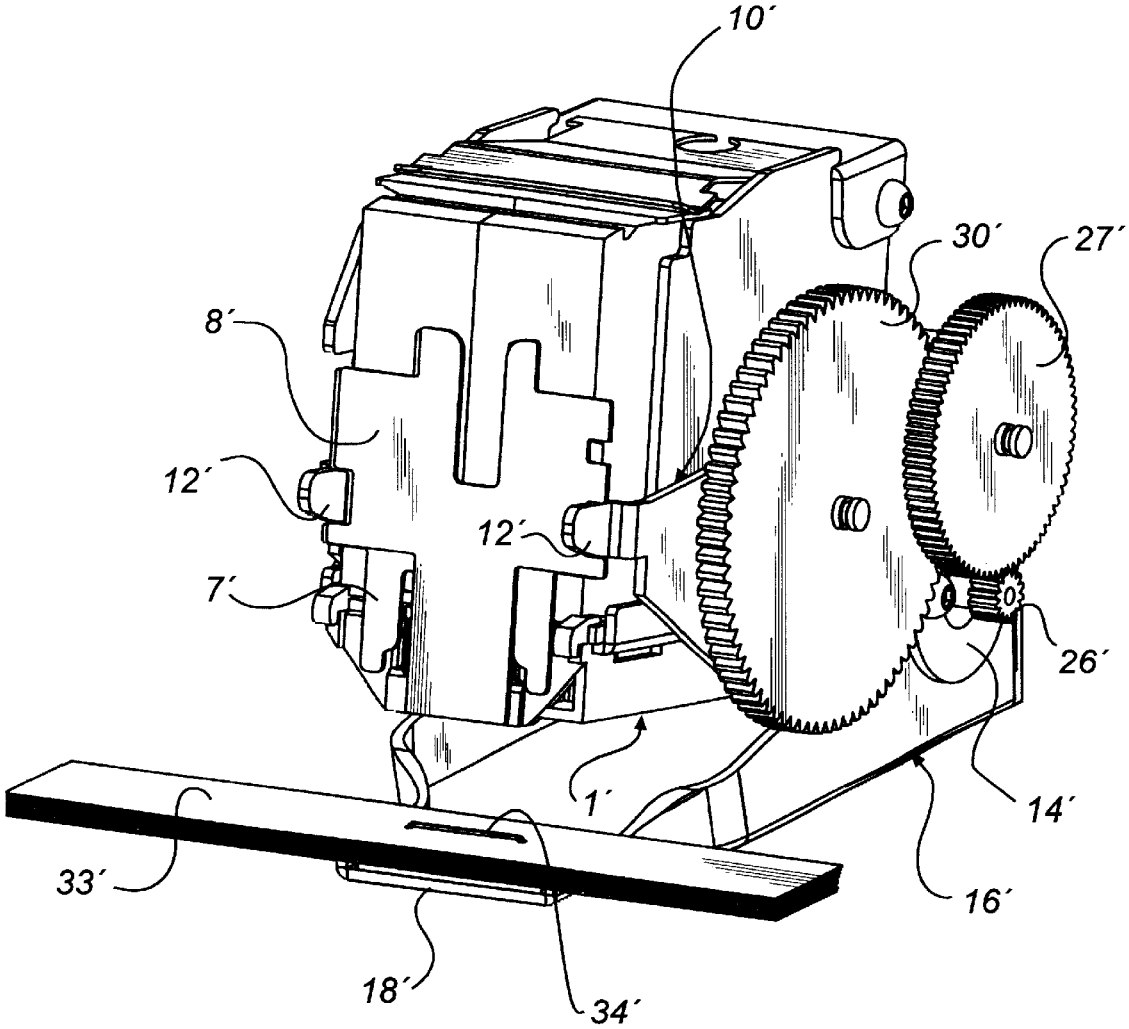
Figure 13:
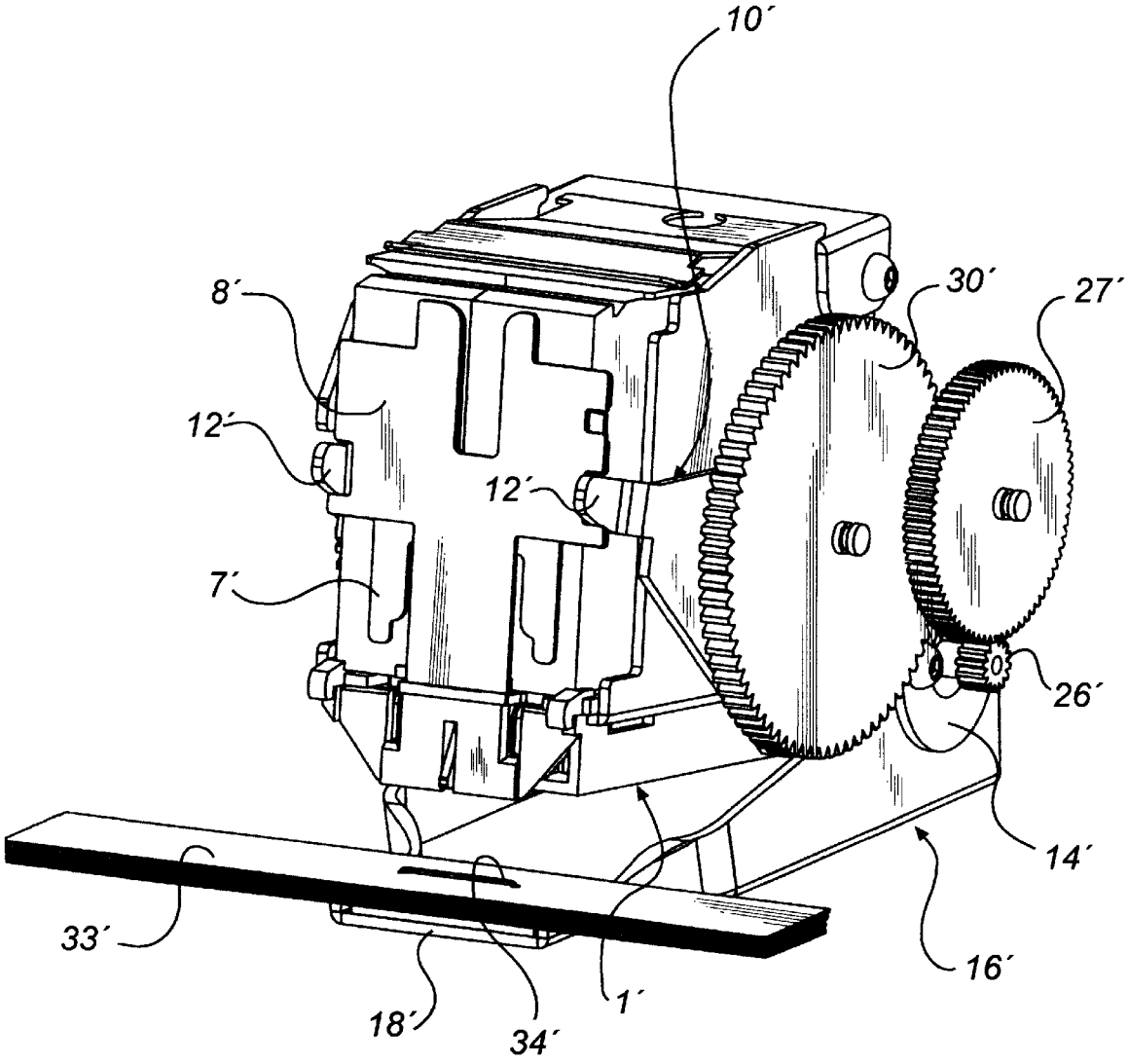

When the operating element 10' cannot be pivoted downwards any further and is thus stopped (FIG. 11), the electric motor 23' enters a stalling state, in which a considerable rise of current is obtained in the motor. This rise of current is used as a signal, which initiates a reversal of the motor. The motor 23' then rotates in such a direction that the stapling element 1' and the operating element 10' are pivoted away from the anvil element 16'. Due to the above-described conditions of inertia, the operating element 10' is then pivoted upwards to its starting position (FIG. 13), first together with the stapling element 1' and then alone, after the stapling element has reached its starting position (FIG. 12). When the operating element 10' has reached its starting position, it cannot be pivoted upwards any further. This results in the electric motor 23' entering a stalling state once again. The considerable rise of current which is then obtained in the motor 23' is used as a signal that stops the motor.

Figure 14:
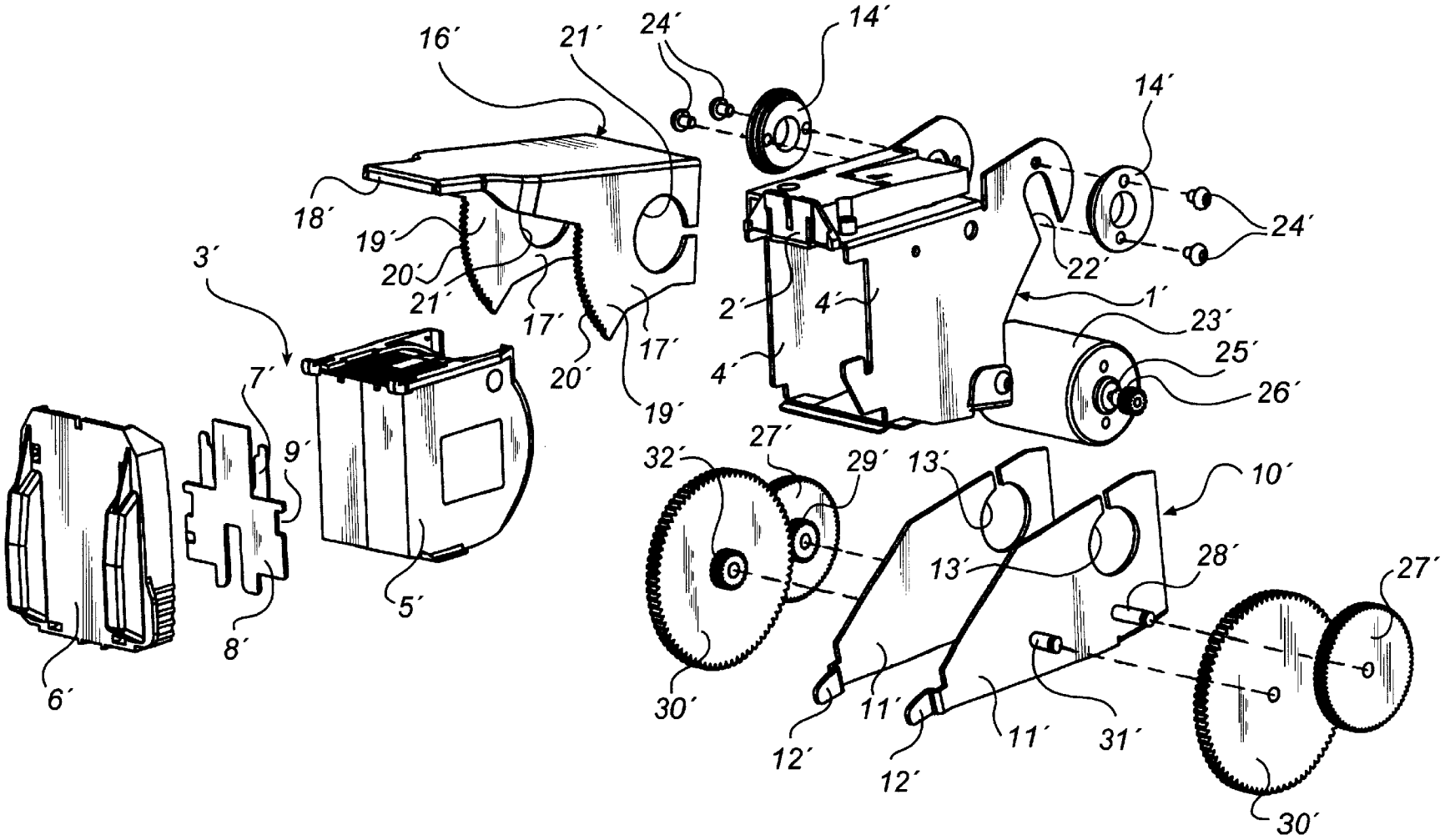
FIG. 14 is an exploded view showing a variant of the embodiment shown in FIG. 8.

The stapler shown in FIG. 14 differs from the stapler according to FIGS. 8–13 essentially only in that the stapler is turned upside-down and that the stapling element 1', and not the anvil element 16', is fixedly arranged in the stapler. As seen, the same reference numerals are used in FIG. 14 as in FIGS. 8–13.

When a sheaf of papers is to be stapled, it is not placed, as in the stapler according to FIGS. 8–13, on the anvil element 16' but on the stapling element 1'. Subsequently, the motor 23' is started in the same way as in the stapler according to FIGS. 8–13, but in this case, due to the above-described conditions of inertia, the anvil element 16' is first pivoted downwards, until the anvil 18' abuts against the sheaf of papers and presses the same against the stapling element 1', also in this case independently of the thickness of the sheaf of papers. When the anvil element 16' cannot be pivoted downwards any further and is thus stopped, the operating element 10' is pivoted upwards and entrains the staple shaper 7' and the staple driver 8' to form and drive in a staple blank and a staple, respectively.

When the operating element 10' cannot be pivoted upwards any further and is thus stopped, the electric motor 23' enters a stalling state and is reversed in the same manner as in the stapler according to FIGS. 8–13. The operating element 10' and the anvil element 16' are then pivoted away from each other. Due to the above-described conditions of inertia, the anvil element 16' is first pivoted upwards to its starting position and subsequently the operating element 10' is pivoted downwards to its starting position. When the operating element 10' has reached its starting position, it cannot be pivoted downwards any further, resulting in the electric motor 23' entering a stalling state and being stopped in the same manner as in the stapler according to FIGS. 8–13.

The above-described embodiments can be modified in different ways within the scope of the appended claims. For instance, the reversal of the electric motor 23, 23' can be controlled in some other manner than by using the rise of current in the stalling state, such as by time control. Furthermore, the electric motor 23, 23' with the gears 26, 26', 27, 27', 29, 29', 30, 30', 32, 32' and the toothed segments 19, 19' can be replaced by any suitable, reversible driving means.

What is claimed is:

1. A stapler for driving staples into objects (33; 33'), such as sheaves of papers, said stapler comprising an anvil element (16; 16'), which has a means (18, 18') for clinching driven-in staples, and a stapling element (1; 1'), which cooperates with the anvil element and which contains staples, one of the anvil element (16; 16') and the stapling element (1; 1') being fixedly arranged in the stapler, and these elements being movable relative to each other between a starting position and a working position, in which they are applied against an object (33; 33'), when this is placed in the stapler between the anvil element (16; 16') and the stapling element (1; 1') to be stapled, and said stapler further comprising a driver (8; 8'), which is reciprocatingly arranged on the stapling element (1; 1') and which is arranged to drive a staple into the object in the direction of the anvil element (16; 16'), and an operating element (10; 10'), which is arranged to reciprocate the driver (8; 8') and which, for this purpose, is movable relative to the stapling element (1; 1'); the anvil element (16; 16') and the operating element (10; 10') being movable back and forth relative to the stapling element (1; 1') in one and the same path of motion, and the anvil element (16; 16') and the operating element (10; 10') being movable relative to each other in said path of motion with the aid of a reversible driving means (19, 23, 26, 27, 29, 30, 32; 19', 23', 26', 27', 29', 30', 32'), characterised in that the operating element (10; 10') is movably connected to the stapling element (1; 1') and the anvil element (16; 16') in such a manner that its inertia against movement relative to the stapling element (1; 1') is greater than its inertia against movement relative to the anvil element (16; 16'), which means that, when the driving means (19, 23, 26, 27, 29, 30, 32; 19', 23', 26', 27', 29', 30', 32') is driven in one direction, the anvil element (16; 16') and the stapling element (1; 1') are first moved relative to each other from the starting position to the working position and the operating element (10; 10') is subsequently moved relative to the stapling element (1; 1') to move the driver (8; 8') in its drive-in direction, and that, when the driving means after reversal is driven in the other direction, the anvil element (16; 16') and the stapling element (1; 1') are first moved relative to each other from the working position to the starting position and the operating element (10; 10') is subsequently moved relative to the stapling element (1; 1') in order to move the driver (8; 8') in the direction opposite to the drive-in direction, and that the driving means (19, 23, 26, 27, 29, 30, 32; 19', 23', 26', 27', 29', 30', 32') is adapted to be reversed, on the one hand, when the operating element (10; 10'), when driving the driving means in said one direction, reaches a first position, in which it cannot move the driver (8; 8') any further in its drive-in direction and, on the other hand, when the operating element (10; 10'), when driving the driving means in said other direction, reaches a second position, in which it cannot move the driver (8; 8') any further in the direction opposite to the drive-in direction.

2. A stapler as claimed in claim 1, characterised in that the driving means comprises a reversible electric motor (23; 23'), and that the rise of current which is obtained in the motor (23; 23') when it stalls due to the operating element (10; 10') being stopped in its movement in said first and second position is used as a signal to reverse the motor (23; 23').

3. A stapler as claimed in claim 2, characterised in that the electric motor (23) is fixed to one of the operating element (10) and the anvil element (16).

4. A stapler as claimed in claim 3, characterised in that the driving means comprises at least one gear (26, 27, 29, 30, 32), which meshes with a rack (19) that is fixed to the other one of the operating element (10) and the anvil element (16).

5. A stapler as claimed in claim 3, in which the stapling element (1) is fixedly arranged in the stapler, characterised in that the anvil element (16), the stapling element (1) and the operating element (10) are arranged in a vertical line and movable relative to each other along this line, the anvil element (16) being arranged above the stapling element (1).

6. A stapler as claimed in claim 3, in which the anvil element (16) is fixedly arranged in the stapler, characterised in that the anvil element (16), the stapling element (1) and the operating element (10) are arranged in a vertical line and movable relative to each other along this line, the stapling element (1) being arranged above the anvil element (16).

7. A stapler as claimed in claim 2, characterised in that the anvil element (16) and the operating element (10) are linearly movable, along one and the same straight line, back and forth relative to the stapling element (1).

8. A stapler as claimed in claim 7, characterised in that the electric motor (23) is fixed to one of the operating element (10) and the anvil element (16).

9. A stapler as claimed in claim 2, characterised in that the anvil element (16') and the operating element (10') are pivotable back and forth relative to the stapling element (1') on one and the same axis.

10. A stapler as claimed in claim 9, in which the stapling element (1') is fixedly arranged in the stapler, characterised in that the anvil element (16') is arranged above the stapling element (1').

11. A stapler as claimed in claim 9, in which the anvil element (16') is fixedly arranged in the stapler, characterised in that the stapling element (1') is arranged above the anvil element (16').

12. A stapler as claimed in claim 1, characterised in that the anvil element (16) and the operating element (10) are linearly movable, along one and the same straight line, back and forth relative to the stapling element (1).

13. A stapler as claimed in claim 12, in which the stapling element (1) is fixedly arranged in the stapler, characterized in that the anvil element (16), the stapling element (1) and the operating element (10) are arranged in a vertical line and movable relative to each other along this line, the anvil element (16) being arranged above the stapling element (1).

14. A stapler as claimed in claim 12, in which the anvil element (16) is fixedly arranged in the stapler, characterised in that the anvil element (16), the stapling element (1) and the operating element (10) are arranged in a vertical line and movable relative to each other along this line, the stapling element (1) being arranged above the anvil element (16).

15. A stapler as claimed in claim 12, characterised in that the electric motor (23) is fixed to one of the operating element (10) and the anvil element (16).

16. A stapler as claimed in claim 15, in which the stapling element (1) is fixedly arranged in the stapler, characterised in that the anvil element (16), the stapling element (1) and the operating element (10) are arranged in a vertical line and movable relative to each other along this line, the anvil element (16) being arranged above the stapling element (1).

17. A stapler as claimed in claim 15, in which the anvil element (16) is fixedly arranged in the stapler, characterised in that the anvil element (16), the stapling element (1) and the operating element (10) are arranged in a vertical line and movable relative to each other along this line, the stapling element (1) being arranged above the anvil element (16).

18. A stapler as claimed in claim 1, characterised in that the anvil element (16') and the operating element (10') are pivotable back and forth relative to the stapling element (1') on one and the same axis.

19. A stapler as claimed in claim 18, in which the stapling element (1') is fixedly arranged in the stapler, characterised in that the anvil element (16') is arranged above the stapling element (1').

20. A stapler as claimed in claim 18, in which the anvil element (16') is fixedly arranged in the stapler, characterised in that the stapling element (1') is arranged above the anvil element (16').

* * * * *